United States Patent [19]

Triantos, Jr.

[11] Patent Number: 4,771,686

[45] Date of Patent: Sep. 20, 1988

[54] APPARATUS FOR CRUSHING SMALL WASTE CONTAINERS

[76] Inventor: John F. Triantos, Jr., 506 Rolling Hills Dr., Colorado Springs, Colo. 80919

[21] Appl. No.: 30,373

[22] Filed: Mar. 26, 1987

[51] Int. Cl.[4] ..... B30B 1/32; B30B 9/00

[52] U.S. Cl. ..... 100/255; 100/131; 100/902

[58] Field of Search ..... 100/902, 131, 252, 240, 100/229 A, 214, 255, 245, 246; 141/73

[56] References Cited

U.S. PATENT DOCUMENTS

| | | | |
|---|---|---|---|
| 3,726,211 | 4/1973 | Gladwin | 141/73 X |
| 3,948,164 | 4/1976 | Pobuda | 100/902 X |
| 4,554,868 | 11/1985 | Zimmer | 100/902 X |
| 4,570,536 | 2/1986 | Dodd | 100/902 X |

*Primary Examiner*—Andrew M. Falik

*Attorney, Agent, or Firm*—Donald W. Erickson

[57] ABSTRACT

Apparatus for crushing waste containers such as cans, oil filters, and the like. The apparatus includes a platform having a drain leading to a reservoir below the platform; a vertical support frame secured to the platform and having two spaced apart vertical columns joined together, near the top thereof, by a horizontal member; a hydraulic ram mounted on said horizontal member, a ram head secured to the lower end of the hydraulic ram adapted for downward and upward movement; and a compartment for receiving waste containers. The base of the compartment is secured to the platform and the sidewalls thereof are secured to the vertical support frame. The compartment has an opening for introducing a waste container onto the platform and removing the container after crushing and a piercing device for puncturing containers placed in the compartment. A hydraulic pump mounted on the platform and connected to the hydraulic ram causes upward and downward movement of the ram head.

3 Claims, 1 Drawing Sheet

APPARATUS FOR CRUSHING SMALL WASTE CONTAINERS

BACKGROUND OF THE INVENTION

Apparatus for crushing or compacting waste containers vary from rather uncomplicated devices as shown by U.S. Pat. Nos. 2,150,812 and 4,459,908 to more sophisticated devices as shown by U.S. Pat. Nos. 4,459,906 and 4,554,868. In spite of the prior art devices, there exists a need for a waste container crusher which is relatively small, and portable, but yet strong, for users such as oil and lubrication stations, gasoline stations, auto repair shops, auto body repair shops, and the like. Under existing regulations in many states, waste containers such as oil cans, oil filters, brake fluid cans, paint cans, and the like can be disposed of only at certain designated dump sites. Oftentimes, these dump sites are more remotely located than the usual public dumps and charge fees for the use thereof. However, under most regulations, the aforementioned waste containers can be disposed of at the usual public dumps if the container is first crushed and the contents thereof drained.

SUMMARY OF THE INVENTION

The present invention is directed at a waste container crusher which is relatively small and portable, but yet strong, to meet the aforementioned need. The apparatus of the present invention is directed at the crushing and evacuation of waste containers of the one gallon size and smaller. The apparatus of the present invention comprises: a platform, said platform having drain means for liquid substances; a vertical support frame having two spaced apart vertical members joined together near the top thereof by a horizontal member; a hydraulic ram mounted on said horizontal member, said ram having at its lower end a ram head for crushing containers; a compartment for receiving a waste container, the base of said compartment being secured to the platform and the sidewalls of the compartment being secured to the vertical members, said compartment having means in a sidewall thereof for placing a waste container on the platform and removing said container after crushing; a piercing means for puncturing a waste container situated in a sidewall of and near the base of said compartment; and a hydraulic pump mounted on the platform and cooperatively connected to said hydraulic ram.

DETAILED DESCRIPTION OF THE INVENTION

Figure 1:
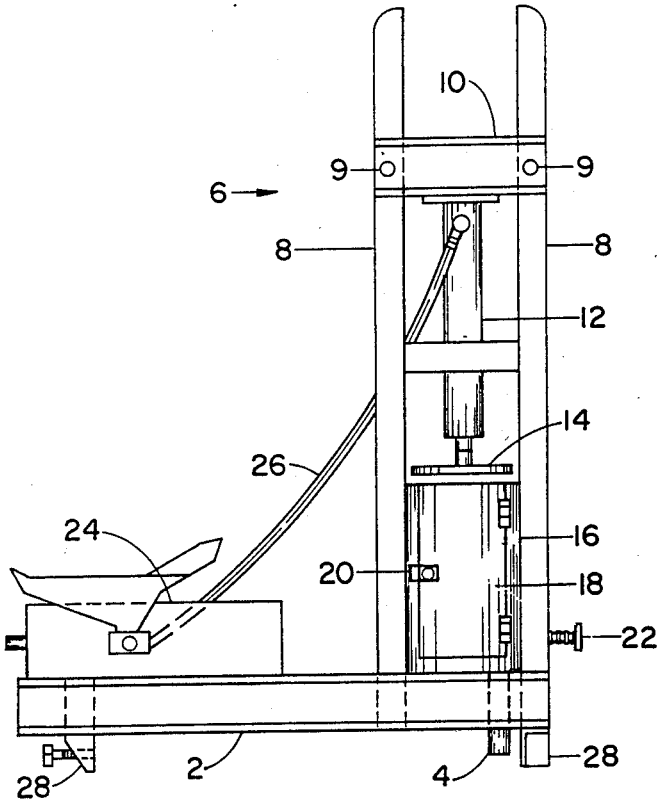
FIG. 1 is a side view of a waste container crusher in accordance with the present invention.
Figure 2:
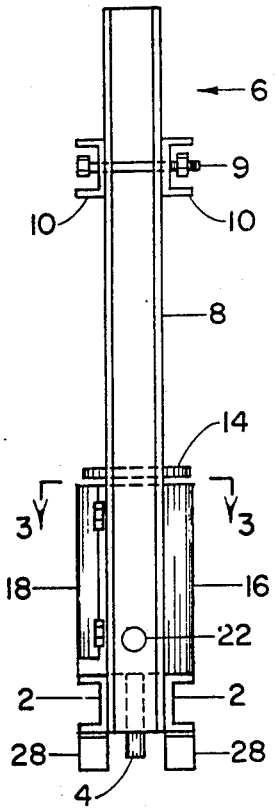
FIG. 2 is an end view of the crusher of FIG. 1.
Figure 3:
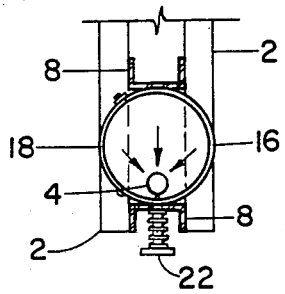
FIG. 3 is a partial top view along line 3—3 of FIG. 2.

Referring to FIG. 1 of the drawings, there is shown a crusher of the present invention comprising a platform 2 with drain means 4 for liquid substances. The drain means, or pipe as shown, can be oonnected by a hose or otherwise to a drum reservoir, not shown, for later disposal of the liquid substances. A vertical support frame 6 having two spaced apart vertical members 8, joined together, near the top thereof, by horizontal support members 10 provides support structure for the hydraulic ram 12. The horizontal members 10 are secured to the vertical members 8 by bolts 9, thereby permitting adjustment to the distance between the ram and platform. The base of the vertical members is preferably welded to the platform. The base of the ram is secured to the horizontal members by bolting or welding. To the lower end of the shaft of the ram 12 is secured, as by welding or the like, a ram head 14 which is in cooperative alignment with compartment 16. As shown, the ram head is circular and the compartment is cylindrical with the diameter of the ram head being somewhat smaller than the diameter of the compartment. The base of the compartment sidewall is welded to the platform and the sidewall itself is welded to the vertical members making a strong unit. The compartment has means in the sidewall for placing a waste container on the platform and removing the container after crushing. As shown best in FIG. 1, a hinged door 18 provided with a bolt latch 20 enables the operator to insert and remove waste containers. A piercing means 22 is provided in the sidewall of the compartment and through vertical member 8 for puncturing waste containers and draining thereof through outlet 4. The piercing means is a sharp pointed spring tensioned bolt which is tapped firmly by the operator to puncture the container. The hydraulic pump 24 is connected by line 26 to actuate and supply power to the ram 12. As best shown in FIG. 3, preferably the platform surface within the compartment is slightly concave or sloped downwardly to drain 4 in order to minimize spillage of liquid when the container is punctured and/or crushed. Optionally, tabs 28 are provided to facilitate positioning of the crusher on a workbench and to provide clearance for the drain.

A suitable air powered hydraulic pump 24 is the Dayton air hydraulic pump No. 4Z482 and a suitable hydraulic ram 12 is the Dayton ram No. 4Z487.

What is claimed is:

1. An apparatus for crushing small waste containers comprising:

a platform, said platform having drain means for liquid substances;

a vertical support frame, the base of which is secured to the platform, said vertical frame having two spaced apart vertical members joined together, near the top thereof, by horizontal support members;

a hydraulic ram mounted on said horizontal members, said ram having a ram head secured to the lower end thereof which is adapted for downward and upward movement;

a compartment for receiving a waste container, the base of said compartment being secured to the platform and in oooperative alignment with said ram head, the sidewall of said compartment being secured to the vertical members, the inside dimension of said compartment being larger than the width of the ram head, said compartment having means in the sidewall thereof for placing a waste container on the platform and removing said container after crushing;

a piercing means provided in the sidewall of and near the base of said compartment for puncturing a waste container; and a hydraulic pump mounted on the platform and cooperatively connected to said hydraulic ram to effect said upward and downward movement.

2. The apparatus according to claim 1 wherein the ram head is circular.

3. The apparatus according to claim 2 wherein the compartment is cylindrical.

* * * * *